US006183114B1

(12) United States Patent
Cook et al.

(10) Patent No.: US 6,183,114 B1
(45) Date of Patent: Feb. 6, 2001

(54) HALOGEN TORCHIERE LIGHT

(76) Inventors: Kermit J. Cook, 8 Congress Ave., Wheeling, WV (US) 26003; Paul Krakow, 3373 McGraw La., Lafayette, CA (US) 94549; Myles Merrell, 11428 Bedforshire Ave., Potomac, MD (US) 20854; Darren Perry, 24 Champney Rd., North Conway, NH (US) 03860-0045

( * ) Notice: Under 35 U.S.C. 154(b), the term of this patent shall be extended for 0 days.

(21) Appl. No.: 09/085,850

(22) Filed: May 28, 1998

(51) Int. Cl.[7] ..... F21V 29/00

(52) U.S. Cl. ..... 362/294; 362/373; 362/345; 362/350; 362/218; 362/264

(58) Field of Search ..... 362/294, 373, 362/345, 350, 218, 264

(56) References Cited

U.S. PATENT DOCUMENTS

| | | | | |
|---|---|---|---|---|
| 3,684,883 | * | 8/1972 | Entwistle | 240/92 |
| 4,290,097 | * | 9/1981 | Block | 362/264 |
| 4,564,783 | | 1/1986 | Krieg et al. . | |
| 4,796,166 | | 1/1989 | Greenberg . | |
| 4,907,137 | | 3/1990 | Schladitz et al. . | |
| 4,949,232 | | 8/1990 | Safyan . | |
| 5,051,875 | | 9/1991 | Johnson . | |
| 5,055,988 | | 10/1991 | Cartwright . | |
| 5,088,012 | | 2/1992 | Burgess . | |
| 5,165,788 | | 11/1992 | McLaughlin . | |
| 5,207,505 | * | 5/1993 | Naraki | 362/373 |
| 5,221,141 | | 6/1993 | Swanson . | |
| 5,412,542 | | 5/1995 | Mandy . | |
| 5,473,523 | | 12/1995 | Von Fange . | |
| 5,473,524 | | 12/1995 | Behringer . | |
| 5,521,365 | | 5/1996 | Malatesta . | |
| 5,593,225 | | 1/1997 | Safyan . | |
| 5,595,438 | | 1/1997 | Burd . | |
| 5,651,608 | * | 7/1997 | Wedell | 362/267 |
| 5,720,549 | * | 2/1998 | Lavy | 362/378 |

FOREIGN PATENT DOCUMENTS

| | | | | |
|---|---|---|---|---|
| WO98/30837 | * | 7/1998 | (WO) | F21V/29/00 |

* cited by examiner

*Primary Examiner*—Cassandra Spyrou
*Assistant Examiner*—Leo Boutsikaris
(74) *Attorney, Agent, or Firm*—Stephen G. Matzuk

(57) ABSTRACT

A light having a shielded fixture housing which comprises a tapered reflector a halogen lamp at the narrowed end, a tempered glass shield at the light-emitting end at a selected distance from the halogen bulb, and vents disposed about the fixture to provide an airflow therethrough. Embodiments according to the present invention pass the Underwriters Laboratory "Cheesecloth Test" and provide a light with significantly reduced fire hazard. Further improvements include specifically disposed temperature sensors to interrupt the power to the lamp if the light is accidentally or intentionally misused.

11 Claims, 2 Drawing Sheets

HALOGEN TORCHIERE LIGHT

FIELD OF THE INVENTION

The present invention relates to light assemblies shielded to protect the surrounding material, in particular, to torchiere lights having a thermal shield to reduce the surface temperature accessible by surrounding materials.

BACKGROUND OF THE INVENTION

Within the last decade, open-top, upward facing "torchiere" style floor lights have become an increasingly popular source of lighting. However, the typical 300 watt torchiere light of this era incorporates a halogen lamp having a bulb external surface temperature of 794 K which presents heat energy sufficient to ignite many materials commonly found in the light operating environment. In fact, the lights are reported to be the source of many fires, leading institutions, e.g. colleges, to ban the lights outright.

Prior attempts to limit the problem have lead some manufacturers to install a wire mesh or glass covers in the region just above the bulb in models sometime advertised as "state of the art." Such wire mesh or glass covers still provide an access to the hot bulb or themselves are above a temperature which can enflame some materials. In order to objectively evaluate the fire hazard problem, Underwriters Laboratory (UL) has proposed a "Cheesecloth" test, wherein an acceptable light must complete seven hours of continuous operation without burning or igniting a piece of cheesecloth placed on top (in the direction of the lights emission) of the light. The wire mesh or glass covers do not significantly reduce the fire hazard, and apparently offer protection to the bulb more than to the surrounding.

SUMMARY OF THE INVENTION

The present invention provides a light having a high temperature bulb in a shielded fixture housing which provides significantly reduced surface, radiation and convection temperatures to remove the fire hazard presented to the surrounding material which may be near or in contact with a surface of the light. The fixture housing includes the halogen bulb within a ventilated, tapered reflector. The bulb is placed at the narrowed end of the tapered reflector and a planar glass shield is placed at the wide end, covering substantially all of the opening thereof. The fixture housing typically includes an annular screen about the periphery of the glass shield and a vent below the bulb to provide an airflow through the fixture and reduced internal and surface temperatures.

Further improvements include electrical temperature sensors disposed at the glass shield to interrupt the power to the lamp if temperatures at the shield exceeded a safe temperature, thus offering added protection in the event of intentional or accidental misuse causing blockage of the flow of air through the vents and/or screen.

Thus, embodiments according to the present invention are expected to pass the "cheesecloth" test and to offer significantly reduced surface operating temperatures to provide a safe, reliable halogen light.

BRIEF DESCRIPTION OF THE DRAWING

These and further features of the present invention will be better understood by reading the following Detailed Description together with the Drawing, wherein.

DETAILED DESCRIPTION OF THE INVENTION

Figure 1:
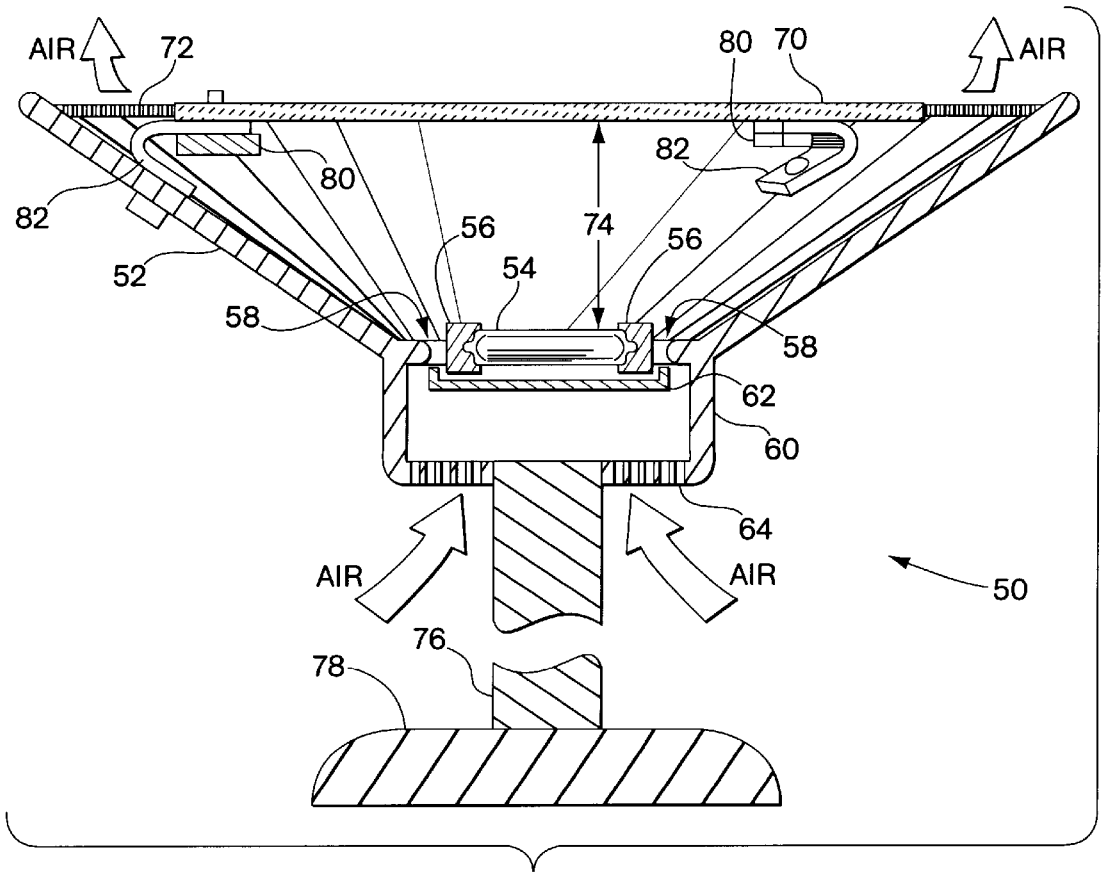
FIG. 1 is a elevational cutaway view of one embodiment of the present invention.

The embodiment 50 of FIG. 1 provides a tapered reflector 52 having an opening at the narrower end of the reflector 52 to receive a lamp 54 and lamp mounting assembly 56 with peripheral spacing 58 to permit airflow thereabout. A cylindrical extension 60 is joined to the narrower end of the reflector 52 and includes a lamp reflector 62 also disposed with peripheral spacing within the cylindrical extension 60 to permit airflow thereabout. The open end of the cylindrical extension 60 receives a screened or perforated metal vents 64 which permits airflow therethrough, but inhibits flammable materials from inadvertently contacting the lamp reflector 62 or the lamp 54 bulb surface.

A tempered glass shield 70 is spaced above the lamp 54 bulb for a 300 watt lamp, in the present embodiment to permit the exterior surface temperature to be no greater than a selected safe temperature. The larger (upper) opening of the tapered reflector 52 is typically circular in shape, as is the glass shield 70. In the embodiment 50 of FIG. 1, the glass shield 70 is generally centered about the opening and disposed above the lamp 54 bulb, and extends substantially, but not entirely to cover the opening of the tapered reflector. The remaining area between the larger opening of the tapered reflector 52 and the shield 70 is covered by a wire screen 72 or equivalent to prevent flammable material from being introduced into the interior region of the light fixture, yet still allow airflow therethrough.

The distance 74 between the lamp 54 bulb exterior surface and the shield 70 is important, and is selected according to the wattage of the lamp 54. Generally, the larger wattage ratings, the greater distance 74. More specifically in the setting of the torchiere light, it has been determined that as distances decrease from 3 cm, the temperature rises approximately exponentially until substantially equal to the bulb surface temperature (about 794 K for 300 watt halogen). For greater distances greater than 3 cm (and a substantially constant lamp 54 bulb diameter), an approximation of a linear temperature falloff may be made. Therefore, according to one embodiment of the present invention, the above temperature/distance relationship is set in a form to provide the preferred (minimum) bulb-to-shield distance 72 (D) according to the following relationship.

$$D \approx \{[(\text{Watts})(1.65\ \text{K/W})+\text{Room Temp}](0.54)-\text{Safe Temp}\}/(17^\circ\ \text{K/cm})+3\ \text{cm}$$

where the Watts is the rated lamp wattage, the Room Temp is the ambient room temperature generally taken to be 300 K, the 0.54 term being empirically determined, and the Safe Temp being a temperature selected to provide the maximum permitted for the desired flammability safety margin, taken here to be 373 K. Accordingly, for a 300 watt lamp, a minimum distance D is about 6.3 cm.

A prototype according to the embodiment 50 of FIG. 1. provides a distance 74 of 8 cm with a 300 watt lamp 54 in a reflector 52 having a larger opening diameter of 16.5 inches with a 13 inch diameter, 0.125 inch thick tempered glass shield 70 mounted slightly below (0.125 inch) the upper edge of the reflector 52, and a metal screen mesh in the remaining 1.75 inch region between the shield 70 and the reflector 52 opening. Additionally, the narrower opening of the prototype reflector 52 is 7.5 inches with the bulb mounting assembly 56 and lamp reflector 62 having about a 0.5 inch air gap within the cylindrical extension 60. Similarly, the lamp 54 bulb surface is spaced about 0.5 inch from the lamp reflector 62, and the cylindrical extension is about 2.25 inches in length beyond its union with the reflector 52. The vents 64, mounted on the lower (distal to the reflector 52) end of the cylindrical extension 60 comprise a metal sheet having about 16–0.125 inch holes per inch. The cylindrical extension is longer when the fixture 50 is inverted (pointed downward) to accommodate greater influx of heated air. Additionally, the extension may comprise different (non-cylindrical) configurations to accommodate esthetics considerations as long as adequate internal air spacing are maintained.

The light fixture embodiment 50 is mounted to a hollow tubular pole 76 through which electrical wiring (not shown) is routed, and is held in a vertical floor position with the aid of a base 78 weighted with ballast to maintain stable vertical orientation of the assembled light.

Also according to the present invention, one or more temperature sensors 80 are disposed substantially at the interior surface of the shield 70. The temperature sensors typically comprise normally-closed bi-metallic switches which open-circuit at a temperature (e.g. the Safe Temp in one embodiment) selected to result in an undesirable temperature on the exterior surface of the shield. The temperature sensors are preferably disposed on shield mounting members, typically metal brackets 82 which mount the shield 70 to the reflector 52 at three equally spaced places according to the embodiment shown. The brackets 82 may also comprise other means to captivate the shield in a spaced relationship to the reflector 72 as taught. The temperature sensors thus placed most advantageously monitor the ambient temperature at the shield near the air flow through the screen 72 while minimally obscuring the light output.

Figure 2:
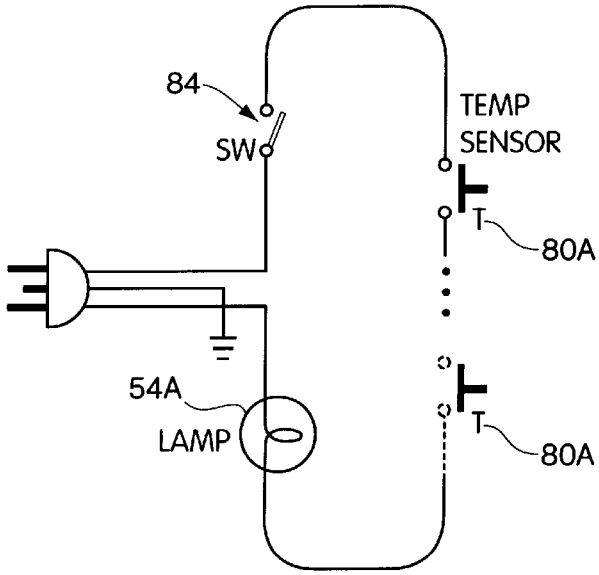
FIG. 2 is an electrical schematic diagram of the embodiment of FIG. 1.

One or more temperature sensors may be mounted as shown in the embodiment 50 FIG. 1 and serially connected 80A as shown in FIG. 2 with the lamp 54A and the power switch 84 so that a temperature exceeding the activation temperature of the bimetallic elements (or equivalent) of the temperature sensors will cause the power to the lamp 54A to be interrupted.

Figure 3:
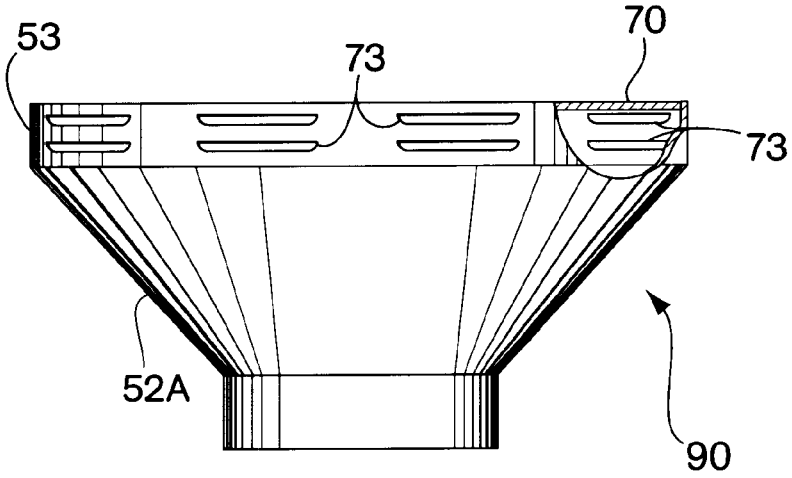
FIG. 3 is an elevational, partial cutaway view of an alternate embodiment of the present invention.

An alternate embodiment 90 of the present invention is shown in FIG. 3, wherein a tapered reflector 52A comprises a larger tubular end portion 53 having a plurality of louvers 73 or other apertures which provide the openings for airflow. In this embodiment, the shield 70 extends to the tubular end portion.

Figure 4:
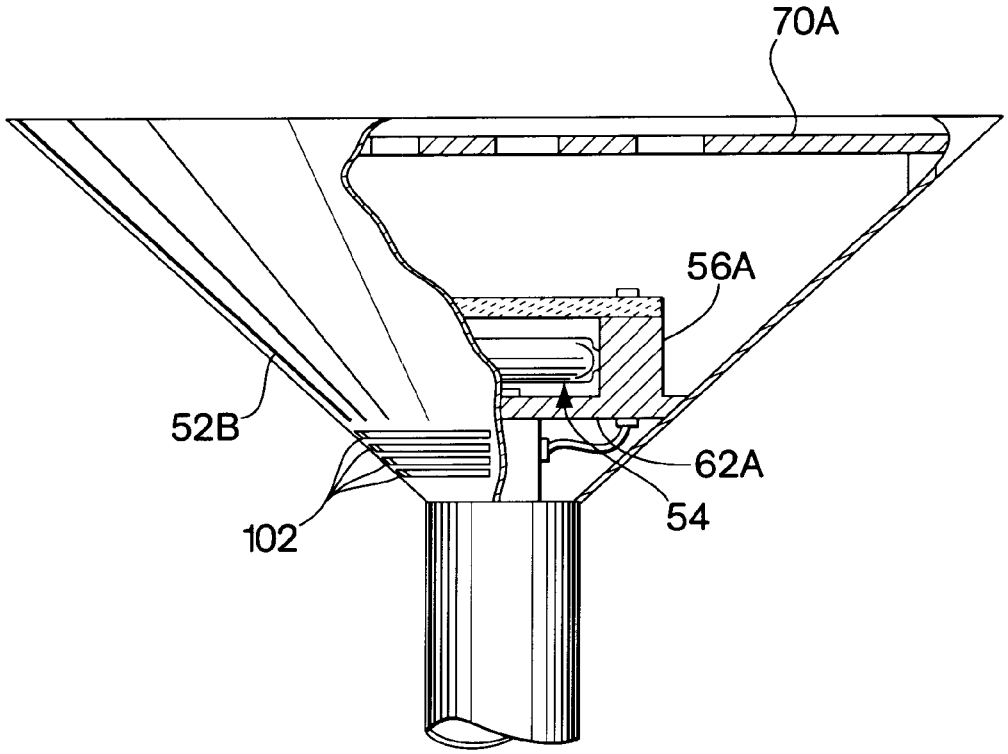
FIG. 4 is an elevational, partial cutaway view of a further alternate embodiment of the present invention.

A further alternate embodiment 100 is shown in FIG. 4 showing a variety of different constituent elements which are used together in the embodiment 100 of FIG. 4, or may be individually in place of corresponding elements in the other embodiments according to one skilled in the art. The reflector 52B exists without extension 60, having instead integrally formed vents 102 which provide the openings into which air flows. The lamp 54 and mounting assembly 56A is retained to the reflector 52B on the lamp reflector 62A which has apertures therein to permit the desired airflow. An ultraviolet light shield 104 is included between the lamp 54 and the shield 70A. The shield 70A itself includes apertures therein to provide an exit for the airflow.

The present invention may be scaled, combined or modified to accommodate differing bulb dimensions and lamp wattage ratings according to the teaching herein. Also, the reflector 52 need not be a highly reflective material. Further modifications and substitutions according to one skilled in the art are within the scope of the present invention which is not limited except by the claims which follow.

What is claimed is:

1. A light fixture for a high temperature light bulb, comprising:

a chimney having substantially vertically oriented side member forming a closed channel and open first and second end, a generally planar member disposed at said channel first end and having openings therein to allow airflow to enter and flow therethrough and being connected to said side member;

a tapered reflector having a first opening adapted to receive said channel second end and having a cross section expanding as distance from said chimney increases and terminating in a second end;

a light bulb support receiving said high temperature light bulb and being disposed between said channel first end and said tapered reflector second end, said light bulb support providing clearance to said tapered reflector and said channel to permit airflow therethrough from said channel; and a solid transparent shield disposed at said second end of said tapered reflector mounted at a distance from said high temperature light bulb sufficient to provide a surface temperature of the surface distal from said high temperature light bulb below a selected temperature and further having a surface area less than the area of said tapered reflector second end to provide at least one opening for said airflow from said chimney to exit said tapered reflector second end.

2. The light fixture of claim 1, further comprising a reflector mounted between said light bulb support and said chimney planar member and being spaced from said side member to provide airflow therebetween.

3. The light fixture of claim 1, wherein said tapered reflector further includes at least one aperture substantially at said second end of said tapered reflector.

4. The light fixture of claim 3, wherein said aperture comprises an open annular region surrounding at least a portion of said solid transparent shield.

5. The light fixture of claim 4, further including a shield substantially entirely covering said annular region and being adapted to permit airflow therethrough.

6. The light fixture of claim 5, wherein said aperture comprises a plurality of openings circumferentially disposed about said second opening of said tapered reflector.

7. The light fixture of claim 1, wherein said solid transparent shield comprises a tempered glass shield.

8. The light fixture of claim 1, further comprising at least one temperature sensor disposed at said solid transparent shield and being connected to de-energize said high temperature bulb if the temperature of said solid transparent shield surface distal from said high temperature bulb exceeds a selected temperature.

9. The light fixture of claim 8, further including a plurality of peripheral supports disposed to mount said solid transparent shield within said second opening of said tapered reflector, wherein said temperature sensor is disposed at said solid transparent reflector by said peripheral support.

10. The light fixture of claim 1, wherein said selected temperature is 373 K.

11. A light fixture for a high temperature light bulb, comprising:

a tapered reflector having an opening at a first end having a cross section expanding as distance from said first end increases toward a second end, wherein said second end comprises at least one opening therein to permit exiting airflow therethrough and wherein said tapered reflector further includes at least one aperture substantially at said first end of said tapered reflector;

a light bulb support receiving said high temperature light bulb and being disposed in said tapered reflector between said first end and said second end, said light bulb support providing clearance to said tapered reflector to permit airflow therethrough; and a solid transparent shield disposed at said second end of said tapered reflector mounted at a distance from said high temperature light bulb sufficient to provide a surface temperature of the surface distal from said high temperature light bulb below a selected temperature.

* * * * *